United States Patent [19]

Callahan

[11] Patent Number: 4,697,227

[45] Date of Patent: Sep. 29, 1987

[54] CONTROL SYSTEM FOR VARIABLE PARAMETER FIXTURES

[76] Inventor: Michael Callahan, 201 West 85th St., New York, N.Y. 10024

[21] Appl. No.: 750,873

[22] Filed: Jul. 1, 1985

Related U.S. Application Data

[63] Continuation-in-part of Ser. No. 443,127, Nov. 19, 1982, Pat. No. 4,527,198.

[51] Int. Cl.[4] ..... F21V 21/00

[52] U.S. Cl. ..... 362/233; 362/268; 362/284

[58] Field of Search ..... 315/312, 313, 321; 362/324, 293, 284, 238, 239, 233, 18, 276, 802, 268, 272

[56] References Cited

U.S. PATENT DOCUMENTS

| | | | |
|---|---|---|---|
| 3,448,338 | 6/1969 | Bentham et al. | 315/312 |
| 3,579,030 | 5/1971 | Bentham et al. | 315/313 |
| 3,706,914 | 12/1972 | Van Buren | 315/312 |
| 3,845,351 | 10/1974 | Ballmoos et al. | 362/253 |
| 4,241,295 | 12/1980 | Williams, Jr. | 315/294 |
| 4,392,187 | 7/1983 | Bornhorst | 362/233 |
| 4,527,198 | 7/1985 | Callahan | 358/185 |

FOREIGN PATENT DOCUMENTS

| | | |
|---|---|---|
| 1434052 | 4/1976 | United Kingdom . |
| 2076180A | 11/1981 | United Kingdom . |

OTHER PUBLICATIONS

Kliegl K-96 SCR$^r$ Dimmer Brochure, 4/1984.

Kliegl Entertainer TM Data Sheet, 3/1983.

Kliegl Digital Lighting Control Systems Brochure, 2/1985.

Colormax TM Brochure, Great American Market, 1/1981.

Showchangers TM Brochure, Strand Lighting, 10/1985.

"Starlight Express", Glenn Loney, *Theater Crafts* Magazine, vol. 19, No. 2, Feb. 1985, pp. 18–62.

"Bright New World?", Tour System Design for the 1980s.

Michael Callahan, *Lighting Dimensions* Magazine, vol. VII, No. 1, Mar. 1983, pp. 62–73.

"Bright New World?", Michael Callahan, *Lighting Dimensions* Magazine, vol. VII, No. 2, Apr./May 1983, pp. 27–39.

"Bright New World?", Michael Callahan, *Lighting Dimensions* Magazine, vol. VII, No. 3, Jun. 1983, pp. 35–42.

*Primary Examiner*—Craig R. Feinberg
*Assistant Examiner*—David A. Okonsky
*Attorney, Agent, or Firm*—Kenyon & Kenyon

[57] ABSTRACT

The application discloses an improved system for the control of a plurality of light projectors each generating a beam suitable for entertainment lighting and each provided with means to vary a plurality of parameters of the beam and with means to conform capable of cooperating to produce a desired adjustment of the beam when provided with a corresponding desired parameter value. The improved system disclosed employs a plurality of local control systems, each with its own local short-term memory, and means are provided for entering desired parameter values, and for storing said values for each of a plurality of desired lighting effects in the short-term memory of the local control system, such that they are each associated with at least one second value which identifies the desired lighting effect. Each of the local control systems has at least one input, and will output a stored parameter value to the means to conform when the second value with which that stored parameter value is associated is provided at said input. A means for selecting, which is capable of producing a plurality of such second values identifying a desired lighting effect to be reproduced, is coupled to said inputs of a plurality of local control systems, preferably by means of a serial data link. Preferably one such local control system is provided for each controlled fixture or device.

48 Claims, 6 Drawing Figures

486
403
420
405
REGISTER
OUT
L
IN
498L
576B
576
562L
562D
311
R
ADD
DEC
LOCAL MEMORY
498
ADD
DATA
575
497
560L
562
560A
R
DECODER
560R
560D
568
561A
T
ENCODER
561T
561E

CONTROL SYSTEM FOR VARIABLE PARAMETER FIXTURES

This application is a continuation-in-part of copending application Ser. No. 443,127, filed Nov. 19, 1982 now U.S. Pat. No. 4,527,198, entitled "Improved Followspot Parameter Feedback", and includes subject matter in Disclosure Document No. 118,922 filed July 20, 1983.

BACKGROUND OF THE INVENTION

This application relates to performance lighting and, more specifically to an improved control system for fixtures capable of varying beam parameters during use.

Performance lighting systems have long employed large numbers of fixtures each selected and adjusted to produce a beam of a particular size, shape, and color aimed at a fixed location on the stage. The only beam parameter variable during the performance is intensity, and the character of the lighting effect onstage is adjusted solely by changing the relative intensities of the variety of fixtures provided.

The advantage of this "one function/one fixture" approach is its use of relatively low technology hardware involving no moving parts and hence relatively high reliability and simple maintainance. The disadvantage is the need for many more fixtures than are used at any one time—or would be required if the fixtures were capable of varying other beam parameters during the performance. There is the direct cost to buy or rent the large number of fixtures required plus their associated supporting structure, dimming equipment, and interconnecting cables as well as the time and labor required to install, adjust, and service this amount of equipment.

It has long been apparent that were fixtures able to change beam parameters in addition to intensity (like color, beam size, or even azimuth and elevation), either as the result of integral remotely actuatable mechanisms and/or devices (like color changers) which may be retrofitted to conventional fixtures, then lighting effects could be varied by actually changing the fixtures' beams rather than dimming between otherwise identical fixtures with different fixed adjustments—requiring fewer fixtures to produce a given lighting design with consequent savings.

Each such "multi-variable" fixture could, over the course of the performance, duplicate the results it currently requires many fixtures to achieve—as well as adding dynamic changes in the beam to the lighting effects possible The viability of employing fixtures with remotely adjustable beam size, color, shape and/or angle as a method of reducing system size depends upon a control system, first disclosed in U.S. Pat. No. 3,845,351, capable of storing absolute desired parameter values for each of the controlled parameters in each of the desired lighting effects and of automatically conforming the fixture's incrementally adjusted beam varying mechanisms to those values.

Similar systems were subsequently disclosed in U.K. Pat. No. 1,434,052 and U.S. Pat. No. 4,392,187, and today, the rental of such systems to concert, television, and theatrical productions is a multi-million dollar industry.

There have, however, been unexpected difficulties with developing a truly practical embodiment of such a control system.

Two approaches have been employed:

One, represented by the Vari-Lite TM system (of Vari-lite, Ltd., Dallas, Tex.), as disclosed in U.S. Pat. No. 4,397,187, employs completely custom hardware and software.

Any such custom control system is very expensive because the number of such systems built relative to even the limited number of conventional lighting memory consoles produced is very small. No significant volume cost reductions are possible and the considerable investment in the "ground up" development of a specialized control system handling up to eight times the amount of data per fixture (relative to a conventional console) can be amortized across only a limited number of units.

Further, it is inevitable that the features and controls provided by any specialized controller will not meet the requirements of all users, and that changes will be requested by users over time. This requires a further investment by the manufacturer in hardware and software revisions, amortizable across the same relatively limited volume.

It had also been widely assumed that remotely adjustable devices (whether color changers, remote yokes, or multi-variable fixtures) would be used on an exclusive basis to maximize the purported gains in system efficiency. Due to a variety of factors including the high cost of such equipment, it has instead been the case that the number of such devices per system may vary widely and that, contrary to expectations, devices of several different types (such as both color changers and remote fixtures) may be employed in the same system, together with conventional fixtures and their controllers.

These "real world" conditions further complicate the development of a suitable memory system, for the unit must be capable of economically driving a handful of such devices or dozens or even hundreds. Clearly, it is difficult to design a single control system capable of varying its memory capacity and outputs over a range of 10:1. Therefore, competing at both ends of this range of applications may require the use of an "overqualified" control system for smaller numbers of fixtures and/or two or more control systems for the large ones. The only alternative is the development of different models of the same control system with a consequent increase in development cost.

It should also be noted that the 10:1 range in the number of controlled devices required by the applications for such equipment also requires an equally flexible method of reliably distributing the necessary data. While the use of multiplexed data links for this purpose has long been known, the inherently higher data rates of multi-variable control systems requires either multiple data links of limited capacity (with a variety of practical drawbacks) or a single data link capable of extremely high data rates without EMI susceptability.

Further, as the control system is optimized for a given controlled device, driving dissimilar devices or major revisions of the same device may be difficult or impossible. Once the commitment has been made to a given control structure and data transmission means, changes in the design of the controlled device which require that additional or different data be stored and transmitted may require an expensive revision of the control system as a whole and/or may render the encoded data on the data link between the control system and the controlled devices incompatable with existing decoder hardware.

This "upwards-incompatability" and lack of "cross-compatability" with other remote devices, are an impediment both to the user (in requiring multiple control systems and operators to attempt to synchronize the different remote devices) and to the manufacturer (in increasing the cost of the revisions required to maintain competitiveness). Such systems will also suffer from further disadvantages when features requiring more sophisticated data manipulation such as the conversion of absolute beam location data to required azimuth and elevation are sought. Because the control system operates on a time-shared basis among the various controlled devices, a relatively modest number of machine cycles required by a given feature must be multiplied by the number of controlled fixtures. The total increase in processor workload may exceed the remaining processor "overhead" and an expensive and time-consuming change of processors may be required.

The second approach to the construction of such systems, typified by the Pana-Spott TM multi-variable fixture (of Morpheus Lights, San Jose, Ca.), does not employ a custom control system, but instead configures the fixtures to allow use of any conventional lighting memory console, such as disclosed in U.S. Pat. No. 3,898,643.

Specifically, the inputs to the Panaspott TM remote fixture are configured to accept 11 parallel 0–10 volt DC outputs as produced by any standard lighting control console; four employed for analog values (azimuth, elevation, beam size and intensity) and seven employed for essentially single-bit digital values (representing the in/out condition of each of the seven frames in the color changer).

The use of a modern memory controller provides a variety of sophisticated features including a CRT, keyboard, data carrier, and cue manipulations without the development costs which attend the creation of a custom controller. There have, however, been several severe drawbacks to the use of such stock consoles One is relative cost. Given the need for storing only one fixture variable and the fact that it is generally desirable for multiple fixtures to share the same discrete output, one $22,000 console generally suffices for a system of 300 conventional fixtures, representing a front-end control cost of only $70 per fixture. In the case of the Panaspot TM, eleven discrete outputs are required for each fixture and, by definition, such fixtures achieve their benefits only if each fixture's inputs are discrete outputs of the console.

Therefore one $22,000 console is required for each eleven remote fixtures for a front end control cost of $2000 per fixture. The number of fixtures controlled per console can be increased by using the same console output as an input to more than one fixture, but this limits the versatility of the fixtures and, in so doing, erodes the justification for their use.

The use of stock lighting consoles for this purpose has also proven to present severe operational disadvantages relative to a custom controller.

Because the "stock" controller's benefits derive from use of a standard lighting control product optimized for cue-to-cue intensity operation, the operator is also required to use input devices and data display formats which are not designed for multi-variable fixture control.

While such a console records and displays the variables for each fixture, all variables for all fixtures are presented uniformly as two numbers: the channel number and a percentage value. A time consuming reference to a list or table is required to determine that the beam size for fixture #8 is controlled by channel #93. Conversely, the CRT display of values is useless without conversion.

Further, such consoles generally provide input devices allowing manual or keyboard adjustment of only a single output or group of outputs at a time. Therefore, most recording operations for remote fixtures require a lengthy series of adjustments, with reference to a table of 100 or more functions between each one.

Such consoles also do not provide data manipulation features unique to multi-variable fixture use, nor can their outputs be reconfigured to provide resolutions greater than or less than 8-bits.

One might suggest modifying the standard memory controller with more appropriate input devices, display modes, outputs, and software, but that contradicts the whole purpose of using an existing controller. Further, such modifications would require the participation of the console manufacturer, either in performing the actual modifications or in providing the documentation to the fixture manufacturer or a third party necessary to do the work. The major dimming equipment manufacturers have made it clear that the size of the market for such modifications does not justify their participation.

A practical control system for remotely-adjustable fixtures therefore requires the development of a new control system approach providing: input devices suited to the needs of the controlled fixture; shared portions of the system of minimum cost; economical operation from a few units to several hundred; a data link capable of handling the maximum data rate reliably, yet inexpensive to decode; capable of mixing various types and generations of controlled device on the same system without modification; capable of modification to meet user requirements at minimal cost.

It is the object of the present invention to provide an improved control system for multi-variable fixtures meeting these requirements.

SUMMARY OF THE INVENTION

The improved control system of the present invention achieves this and additional objects.

Prior art systems employ a centralized control system with a single memory means connected to the plurality of controlled fixtures. In the system of the present invention, outputs of a supervisory control unit at a central location are coupled to the inputs of a plurality of local control systems. Each such local control system has an associated memory means in which are stored desired parameter values for at least one remotely adjustable fixture, the output of the local control system serving as an input to a means for conforming the adjustable parameters of the controlled fixtures to the desired values.

Desired parameter values for the fixtures may be entered into the memory means associated with the local control system prior to the performance by means of input devices and/or a data carrier associated with either the local control system and/or the supervisory control unit.

During the performance, an output of the supervisory control unit selects the location in the memory means of the local control systems at which the desired parameter values for a given lighting effect are stored, causing the fixtures to be conformed to the desired values.

The same output of the supervisory control unit may be supplied to all local control systems, causing selection of stored values at corresponding memory locations, but preferably means are also provided to select data stored at different addresses in different local control systems.

The same output of the supervisory control unit may cause both the selection of the desired stored parameter values and the conforming of the fixture's mechanisms to those values or separate outputs may be employed for each function.

Direct control of the fixture from the supervisory control unit may also be provided during the performance.

The benefits of the control system of the present invention are many and immediate:

The number of such local control systems (and as such fixtures) which may be controlled by the same supervisory control unit is essentially unlimited.

The supervisory unit need contain no cue memory of its own and negligible processor power, but simply serve as a terminal providing input controls and a data carrier along with the minimum of hardware required for communication with the local control systems.

The data rate between the supervisory control unit and the local control systems during performances is minimal and remains so regardless of the number of controlled devices Preferably, a duplicate memory means is provided at the supervisory level to further reduce communications requirements.

As a result, it will be practical to employ desirable techniques, like power line communications between the supervisory unit and the local systems, in many applications which had heretofore not been useable.

DETAILED DESCRIPTION OF THE INVENTION

Figure 1:
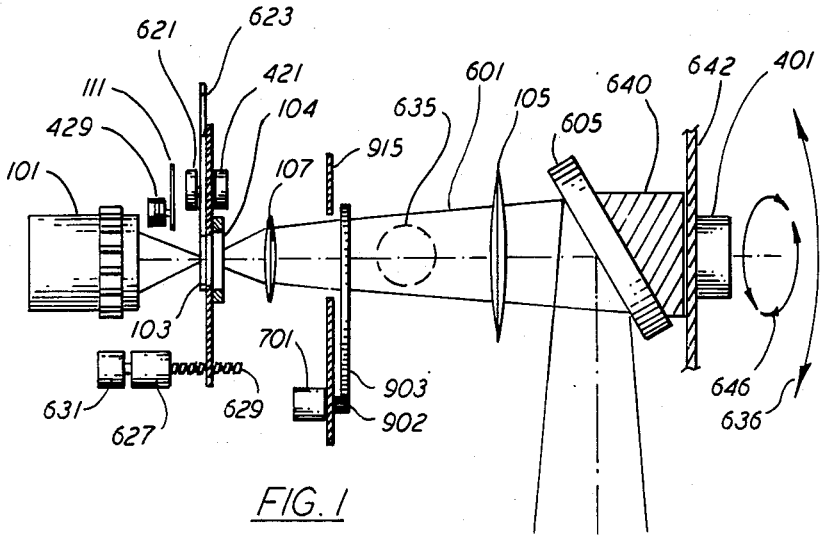
FIG. 1 is a sectional view of a multi-variable fixture as may be employed with the control system of the present invention.

Refer now to FIG. 1, a sectional view of a multivariable fixture as may be employed with the control system of the present invention, equivalent to FIG. 1B of the patent application Ser. No. 443,127. Parts having the same function in both Figures are identified with the same reference number The optical system of the fixture includes light source 101 with its associated reflector and a gate or aperture 103 imaged by a pair of lenses 105 and 107.

Beam intensity may be remotely adjusted by means of dowser 111 and its associated beam intensity actuator 429, although an electronic dimmer as disclosed in U.S. Pat. No. 3,397,344 may also be employed.

Beam size may be remotely adjusted by means of iris 104 and its associated actuator 421, and/or by other means such as changes in system focal length by relative movement of lenses 105 and 107 or a variable curvature mirror 605 as disclosed in U.S. Pat. No. 4,460,943.

Beam shape may be varied by means of gobo wheel 623 and its associated actuator 621.

Beam edge sharpness may be varied by moving the aperture assembly along the optical axis with actuator 627, although more conventional movement of a lens may also be employed.

Beam azimuth and elevation may be adjusted by means of either two-axis displacement of the fixture, as disclosed in U.S. Pat. Nos. 1,680,685 and 1,747,279, or of a beam-directing mirror as disclosed in U.S. Pat. No. 2,054,224. Preferably, however, beam angle is adjusted by reflection from mirror 605 which is mounted by bracket 640 to motor 401 which, in turn, is mounted to the forward end of the fixture chassis 642. This allows the rotation 646 of the beam in a first plane perpendicular to the optical centerline. The fixture chassis 642, in turn, is supported at its center of gravity by a yoke and pivot driven by motor 635 which allows the rotation 636 of the fixture in a second plane parallel to the optical centerline yet always perpendicular to that of the first plane of rotation for the beam.

Figure 5A:
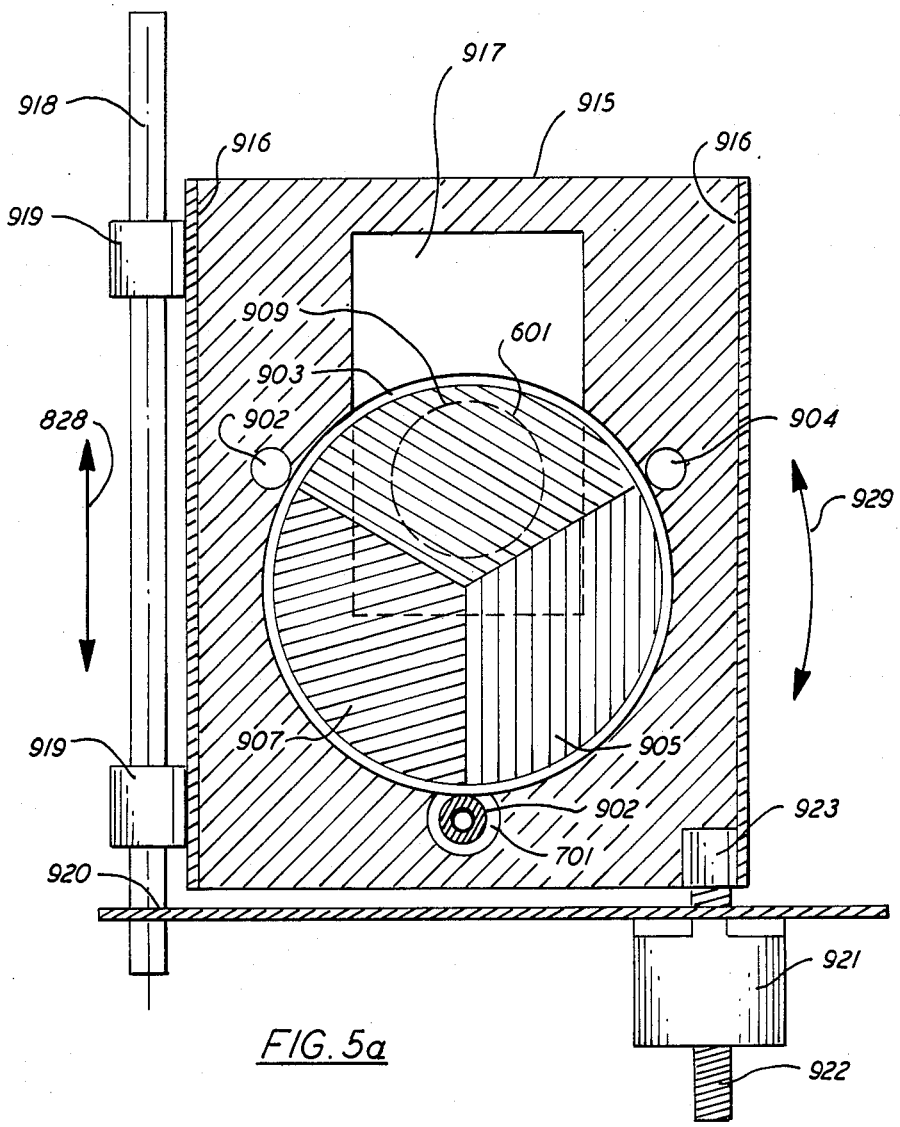
FIG. 5A and 5B are detailed views of a color changing method as may be employed with the control system of the present invention.
Figure 5B:
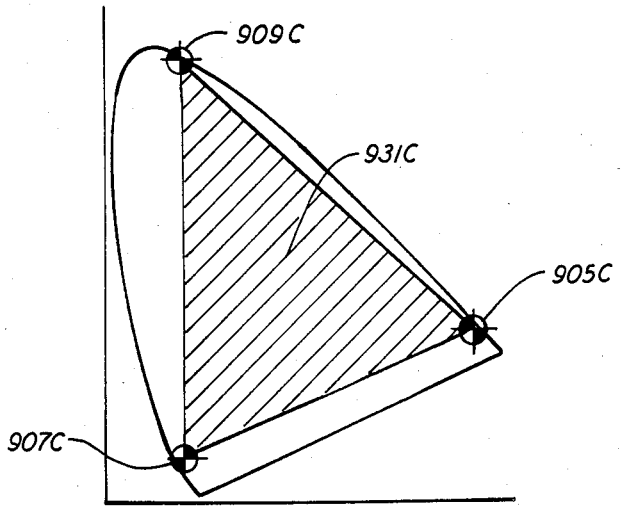

Similarly, the color of the beam 601 may be varied by any conventional means including a color wheel (as disclosed in U.S. Pat. No. 1,820,899); a semaphore changer (as disclosed in U.S. Pat. No. 2,129,641); or a roller changer (as disclosed in U.S. Pat. No. 3,099,397). Preferably, however, the color changing system illustrated in FIG. 5A and 5B would be employed. Three segments of interference-type filter material 905, 907, and 909 (such as manufactured by Optical Coating Laboratories, Inc., Santa Rosa, Ca.) of additive color primaries with CIE chromaticity coordinates 905C, 907C, and 909C form an array supported by rim 903 and rotated by motor 701 via rollers 902 and 904 mounted to support plate 915. Support plate 915, which is located in a hyperfocal region of the optical system, may be displaced along an axis in a plane perpendicular to the optical centerline of beam 601 on linear bearings 919 riding on rail 918 by motor 921 driving lead screw 922, such that the relative proportion of beam 601 passing through the filter array may be varied. Opening 917 in plate 915 allows passage of the beam. The combination of array rotation 929 and displacement 928 allows varying both the proportion of primaries and their saturation to synthesize any color sensation within area 931C.

While the fixture illustrated in FIG. 1 provides means to vary all beam parameters it will be understood that the improved control system of the present invention may be employed with fixtures designed or adapted to remotely adjust any number or combination of parameters, and with devices like color changers and remote yokes designed for use with conventional fixtures.

Similarly, a variety of actuators and actuator drives may be employed in either open or closed loop operation.

Figure 2:
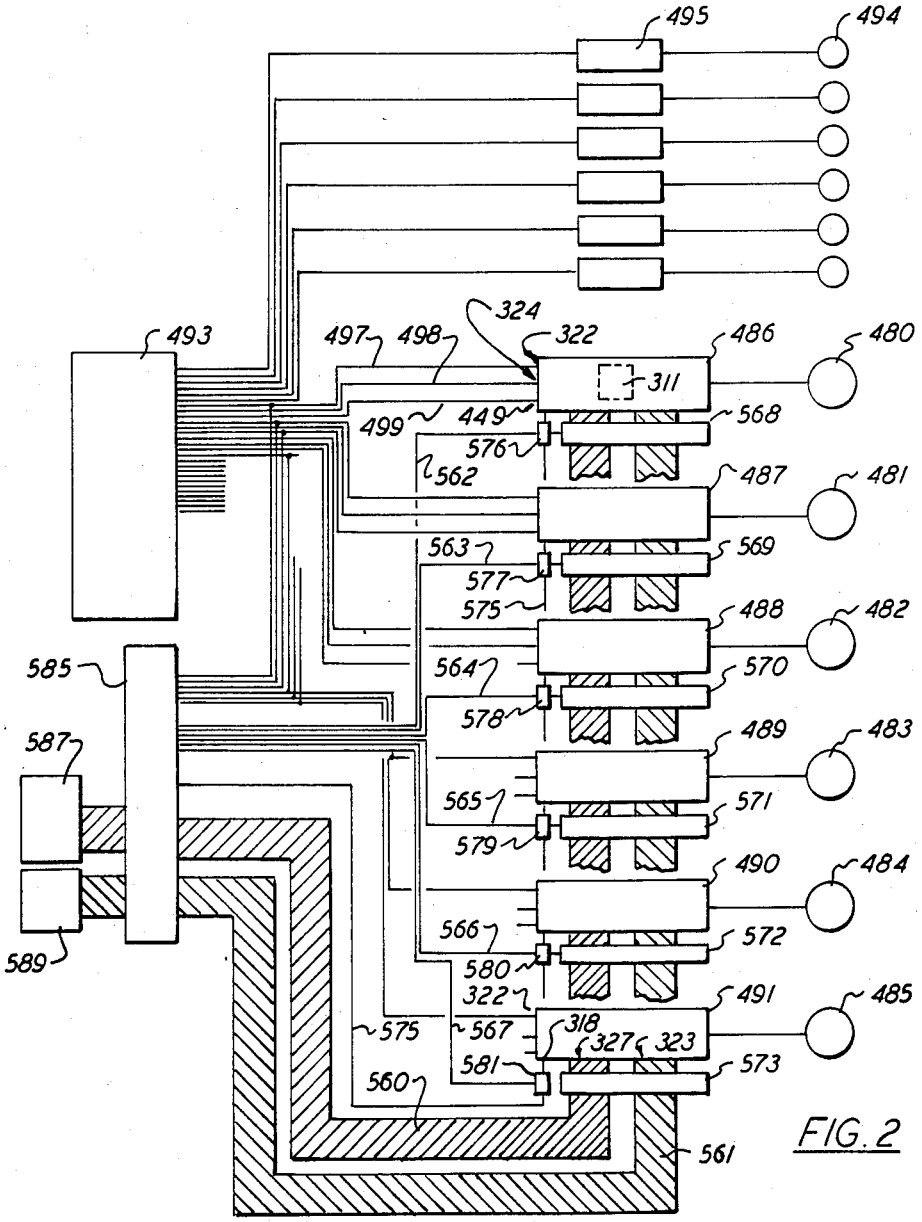
FIG. 2 is a block diagram of the control system of the present invention.

Referring now to FIG. 4B of the parent application Ser. No. 443,127, reproduced as FIG. 2, the structure of the improved control system of the present invention will be described.

A performance employs a plurality of multi-variable fixtures 480–485, together with conventional fixtures 494 whose intensity is controlled by electronic dimmers 495 responsive to conventional memory console 493.

The improved control system of the present invention employs a plurality of local control systems 486–491, which may be similar to that illustrated in FIG. 4A of the parent application Ser. No. 443,127. Each such local control system 486–491 includes a memory means 311 in which may be stored desired parameter values for the fixtures controlled by that system for each of a plurality of lighting effects. Each such local control system provides an input 322, which may be used to select the location in memory 311 at which the parameter values for a given lighting effect are stored. A means is provided, illustrated here as line 497, to couple the setting selection input 322 of the local memory means to the supervisory control unit 493. A single output of supervisory unit 493 may be employed, such that all local control systems are invariably directed to the same memory location, but preferably, the system allows different local control systems to be directed to different addresses as a method of increasing both flexibility and effective memory capacity.

The local control systems may conform their associated fixtures to the desired parameter values upon receipt of a setting selection input, but preferably, a separate output of the supervisory unit, illustrated as line 498 to input 324 of local control system 486, can be employed for a "Load" instruction.

The local control systems may record desired intensity in their memory means, but preferably, alternate and/or supervisory control of intensity may also be exercised from the supervisory unit, illustrated as line 499 to input 449 of control system 486.

As noted in the referenced application, in the most basic embodiment, each local control system must be provided with input, display, and data carrier facilities.

Accordingly, the parent application Ser. No. 443,127 discloses means for transferring data to and from shared input, display, and data carrier facilities at the supervisory level, illustrated as data busses 560 and 561 which are common to the input ports 327 and output ports 323 of the local control systems 486–491. Means are provided, in the form of "System Select" lines 562–567, to selectively couple local control systems to the busses under the control of the supervisory data carrier 585. Similarly, means are provided in the form of line 575, for the supervisory data carrier 585 to cause selected local control systems to record data present on buss 560 in their memory means. Supervisory controls 587 and displays 589 may also be coupled to the parameter value busses between the supervisory level and the local control systems. In the manner described in the parent application Ser. No. 443,127, parameter data may be transferred between the supervisory level and the local control systems for the recording, adjustment, and display of desired parameter values, and their up-loading to and down-loading from a common data carrier. These supervisory facilities may be provided by the conventional lighting controller 493 or by custom hardware or by a combination of the two. However, unlike prior art systems, the centralized portion of the system of the present invention need contain no cue memory of its own and negligible processor power, simply serving as a terminal providing input controls and a data carrier along with the minimum of hardware required for communication with the local control systems, minimizing its cost and complexity, whether a custom controller or modification of a conventional one. In fact, the preferred embodiment employs the combination of the conventional memory controller used for the conventional fixtures and a custom controller providing input devices, displays, data carrier, and an output for the multi-variable fixtures, with an output of the conventional controller used as the setting selection input to the multi-variable fixtures as a method of synchronizing the operation of the two groups of fixtures. Synchronization of the two groups of fixtures thus requires that the conventional lighting controller produce only a cue number and "Load", a relatively modest request, involving no reduction of channel capacity or processor time.

Conversely, as many such consoles provide for an external "go" command, the supervisory control unit could maintain the cue sequence and drive the conventional controller rather than vice versa.

Figure 3:
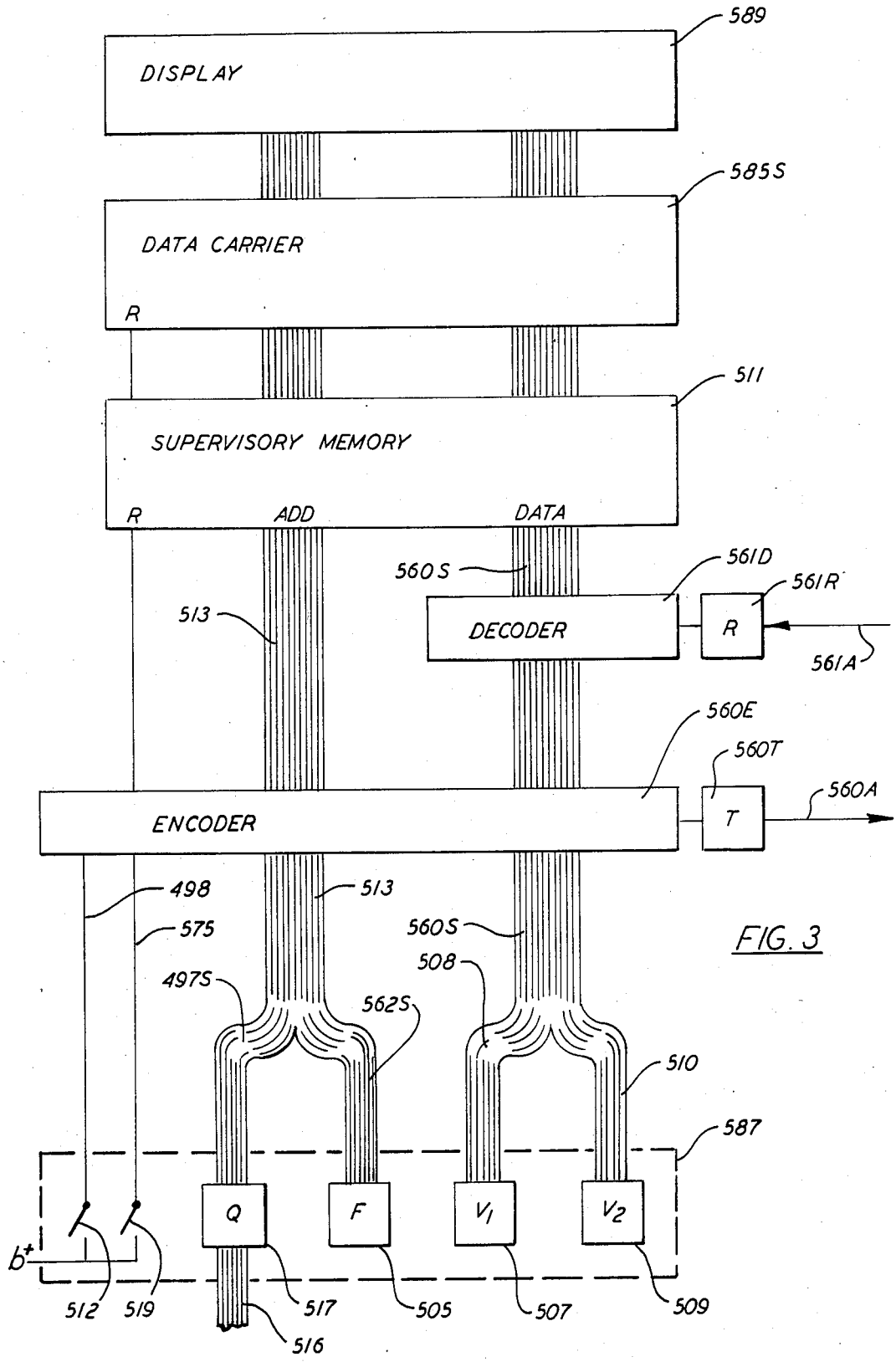
FIG. 3 is a detailed view of one embodiment of the supervisory control unit of FIG. 2.

Refer now to FIG. 3 where constructional details of a supervisory control unit are illustrated.

Supervisory controls 587 include a two master mode switches: a System Record switch 519 which causes the local control systems to store parameter values at the address specified by the Setting Select switch 517; and a System Load switch 512 which causes the local systems to conform fixture parameters to the selected values. A Fixture Select switch 505 and input controls 507 and 509 for setting the desired values of two parameters are provided. A port 516 is provided so that setting selections may be entered from an external device, such as a conventional lighting controller, in the manner previously described.

Outputs 497S and 562S of the Setting Select and Fixture Select switches form an address buss 513 which serves as an input to memory means 511, display 589, and data carrier 585S. The outputs 508 and 510 of parameter input controls 507 and 509 form a data buss 560S which serves as an input to memory means 511, display 589, and data carrier 585S. Outputs 575, 498, 497, 562, and 560S are also provided to encoder 560E for transmission via transmitter 560T to the plurality of local control systems 486–491 via data link 560A.

The use of multiplexed communications between the system controller and multi-variable fixtures is disclosed in U.S. Pat. Nos. 3,845,351 and 4,392,187, and is widely employed. Circuitry for digital asynchronous communication between a lighting controller and a plurality of receivers is described in particular detail in U.S. Pat. No. 4,095,139.

Figure 4:
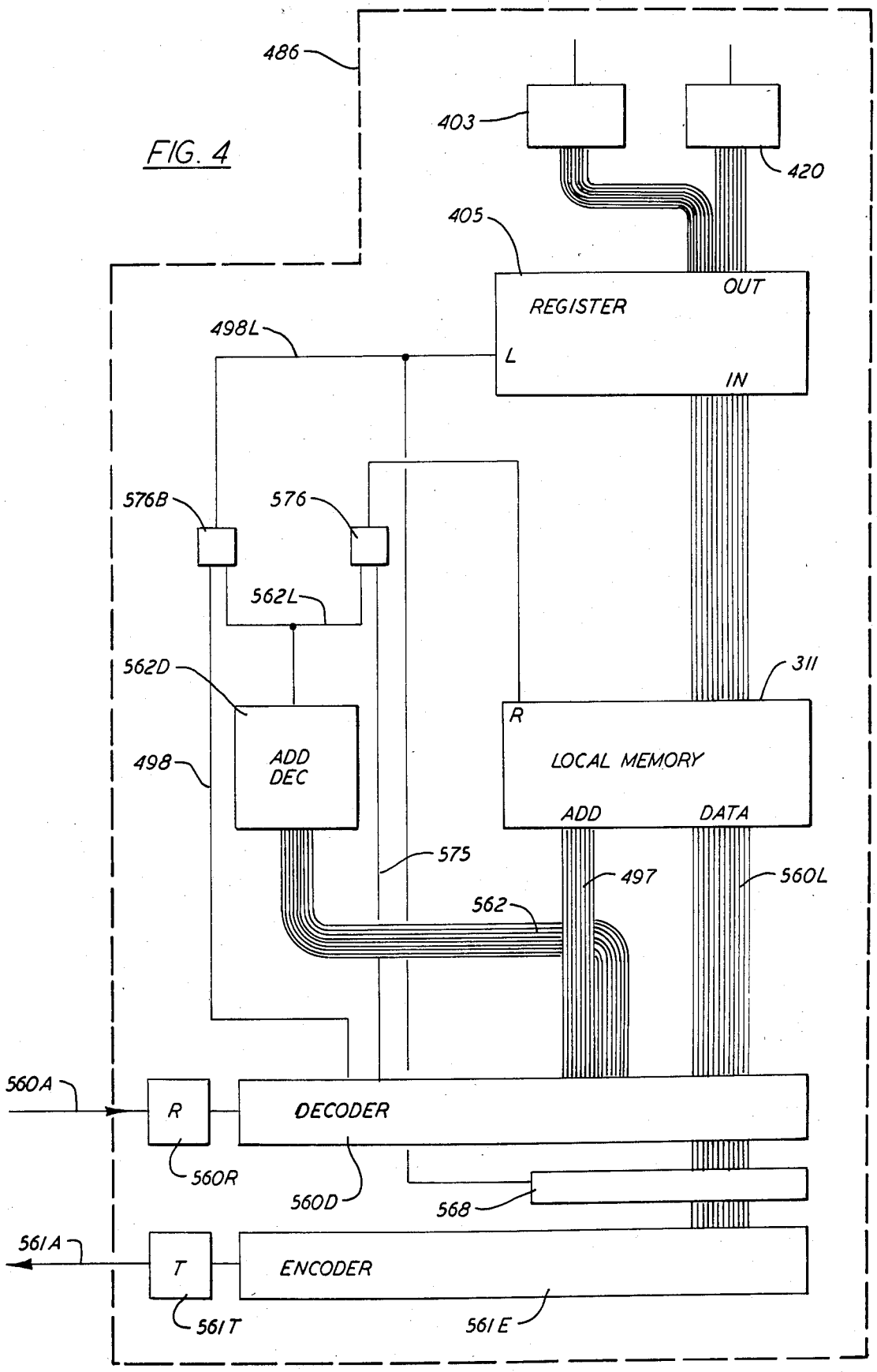
FIG. 4 is a detailed view of one embodiment of a local control system of FIG. 2.

Refer now to FIG. 4 where constructional details of a local control system are illustrated.

Local control system 486 includes local memory means 311 whose data port is connected to parameter value buss 560L which also serves as an input to register 405, whose load input is connected to System Load line 498 via AND gate 576B, whose second input is connected to output 562L of address decoder 562D. The output of register 405 serves as input to motor drives 403 and 420. The address port of memory means 311 is connected to setting select line 497. The fixture select buss 562 is connected to address decoder 562D, which is strapped to recognize the address assigned to the fixture, and which produces an output on line 562L upon doing so. This output serves as an input to AND gate 576 whose second input is the System Record line 575, and whose output is connected to the Record input of memory means 311. Inputs 497, 498, 562, 575, and 560L are connected to the output of decoder 560D which receives data from the supervisory unit over data link 560A via receiver 560R.

It will be apparent that parameter values may be entered into the register 405 of local control system 486 by closing the System Load switch 512, selecting the desired fixture with Fixture Select switch 505, and adjusting input controls 507 and 509 as required. Once the desired values have been reached, they may be entered into local memory means 311 by selecting a cue number with Setting Select switch 517 and closing System Record switch 519.

Desired values can also be "blind recorded" without display onstage by closing the System Record switch 519 with the System Load switch 512 open.

Fixture parameters can be conformed to recorded values by selecting the desired cue number with the Setting Select switch 517 and closing the System Load switch 511.

As previously described, the parameter value data stored in the memory means 311 of the local control systems can be up-loaded to a common display 589 or data carrier 585A at the supervisory level. Accordingly, FIG. 4 illustrates parameter data buss 560L as paralleled to both decoder 560D and encoder 561E via tristate driver 568. Parameter data present on buss 560L will thus be transmitted via data link 561A to the supervisory unit for display or recording, in the manner described in the parent application Ser. No. 443,127, when the appropriate fixture address is present on input 562. It will, however, be apparent, that either two simplex or one duplex data link are required for such communication, and that sophisticated display capabilities at the supervisory level will require significantly higher data rates on the data links as the supervisory unit querries the local control systems. It is, therefore, an object of the present invention to provide an improved control system which allows centralized display and data carrier facilities with little or no requirement for bidirectional communication.

Refer now to FIG. 3, where an additional memory means 511 is illustrated, connected in parallel to the output of the supervisory unit to the local control systems. It will be apparent that through the normal operation of the system as disclosed, each parameter value stored in a local memory means 311 of a local control system will automatically be duplicated in memory means 511 of the supervisory unit. The display of parameter values or their storage thus may employ the duplicated values stored in memory means 311, without consulting the memory means 311 of the local control systems, minimizing communications requirements on the data link 561A (and indeed permitting simpler embodiments of the system to be simplex in operation). The improved system of the present invention, however, still allows central display and data carrier features. And, while it does require a memory means 511 of sufficient capacity to store all parameter values in all cues, because for actual operation only the local memories 311 are employed, the supervisory memory 511 may comprise a comparatively economical device (in some cases, the data carrier itself).

An additional benefit of the reduction in data rates between the supervisory unit and the local systems is the ability to use data links such as infrared, ultrasonic, or power line carriers which had heretofore not been practical for such applications because of the limits on their maximum data rates.

While the operation of the system of the present invention is illustrated with hardware, microprocessors may be employed at either or both the local or the supervisory level. Indeed, it will be understood that the use of a processor at the local control system offers additional benefits.

One such benefit is increased sophistication in the transfer of data between the local system and the supervisory level—and indeed the transfer of data between local systems, such as between the system associated with a damaged fixture and that associated with a spare.

Another such benefit is the use of the local processor to perform data manipulation for its associated fixture. The employment of a microprocessor is for each local control system produces a "parallel processor" architecture in which, unlike prior art central systems, relatively sophisticated data manipulation can be performed without a substantial increase in system cost by "jobbing out" the task to the local control systems. As each increase in the number of controlled devices is accompanied by an increase in local control systems and with them, processor power, the improved control system of the present invention minimizes the cost of the shared portion (the supervisory control unit) and allows variations in system size from a few fixtures to several hundred with no modification to the supervisory unit, to the local control systems, or loss of response time, data capacity, or features.

One highly desirable data manipulation is the calculation for each fixture of the azimuth and elevation settings required for the beam to intersect an absolute location onstage from its current location over it.

By exploiting the communications capabilities of the system, the number of fixtures whose location in space must be reentered when the position of the truss or pipe supporting them changes can may be minimized. While the position of the fixture support structure relative to the stage changes, the relative positions of those fixtures on a common truss or pipe seldom does. Therefore the first and last fixture on an overhead pipe or truss might be "taught" their positions, preferably by means of an input from a position control system or sensor associated with the truss or pipe, but then communicate them to those fixtures mounted inbetween which, having previously been provided with their offsets relative to the "taught" units at the first setup, can calculate their own locations.

Further, it will be apparent that several techniques for controlling the rate at which parameters are changed will be possible. Different rates and start times are extremely complex to produce in prior art systems. It will however be apparent that a control system of the present invention whose local memories contain not only the desired condition for each cue but the desired rate of change could readily allow all units to perform in synchronization, but could equally well be used to produce individually specified rates and start times. The supervisory unit need only provide the Load instruction, and each local control system could start its transitions and vary their rates as instructed with virtually no practical limits on the complexity of the cue. Yet this capability may be provided with little or no impact on system size or cost. Similarly, each local control system can adjust its own rate of parameter change such that all parameter changes start and finish together, regardless of the variations in the amount of adjustment required.

The control system of the present invention thus not only allows any number of local control systems, and as such controlled devices, to be paralleled to the same supervisory unit and its data link, but so long as the local control systems are compatable with the data link, this approach places no limitations on the variety of control systems which can be connected with a common supervisory unit or data link; the number of variables they can maintain; and the number and type of devices they can control. There is, therefore, no reason why the same supervisory unit and buss cannot connect and coordinate color changers, remote yokes, and remote fixtures in any number and combination, each such device employing a local control system optimized for its function.

Further, as many of the same controls are required for the various types of controlled devices, the appeal of the system can be maximized, and its development cost minimized, by designing a "universal" supervisory control unit which is capable of adjusting any automated lighting product accepting the system's communication protocols.

While the simplest embodiment of the system of the present invention provides a corresponding memory location to be provided for each possible setting selection input/cue number, it will be recognized that a linked-list technique can be employed which allows the local control systems to use memory capacity only for cues in which the controlled device is active, maximizing the efficiency with which memory is employed.

It should also be noted that "transparent access" can be provided to the controlled devices for adjustment by direct command from the supervisory level with or without reference to the supervisory memory means in the prior art manner.

A hardware design for the local control unit is also possible which stores the operating program in an electrically-alterable memory accessable in certain modes from the supervisory level, such that an operator need only insert a data carrier containing the most current operating software version for the local system into the supervisory unit and download it to the local control system, such that all local systems, regardless of data of manufacture, thereafter operate on the most current software version and therefore offer the latest features and capabilities.

While the local control system would preferably be made integral with one controlled device, in some low-end applications (such as color-changers and remote yokes) it may prove more economical to locate them at an intermediate level such that one local control system drives, for example, four to eight such devices Ideally, the hardware design for such a local control system would allow the same printed circuit card to be applied to a number of different applications on an OEM basis with little or no modification.

What is claimed is:

1. A control system for a lighting system, said lighting system including: a plurality of light projectors, said projectors each generating a beam suitable for entertainment lighting and each of a plurality of said plurality of projectors provided with: means to vary a plurality of parameters of said beam, including the azimuth and elevation of said beam; and means to conform, said means to confrom operable from a remote location, having an input, having an output coupled to said means to vary, and cooperating with said means to vary to produce a desired adjustment of said azimuth and elevation of said beam in response to the presence of a corresponding first value set at said input, said control system comprising:

(a) at least one means for selecting a desired lighting effect to be reproduced, said means for selecting disposed at a location rerote from said projectors, having at least a first output, and capable of producing a plurality of second values at said first output, each of said second values identifying a desired lighting effect;

(b) at least one means for entering at least one of said first value sets corresponding to a desired azimuth and elevation adjustment for at least one of said projectors, said means for entering disposed at a location remote from said projector and having at least one output;

(c) a plurality of local control systems capable of operation at spaced apart locations, each of said local control systems:

i. having at least one input, said input coupled to at least said first output of said means for selecting;

ii. having at least one output for said first value sets each corresponding to a desired azimuth and elevation adjustment for at least one of said projectors, said output of said local control system coupled to said input of said means to conform o said at least one light projector;

iii. including a local short-term memory capable of storing at least five of said first value sets, each of said first value sets corresponding to the desired azimuth and elevation adjustment of said beam of at least one of said projectors in at least one desired lighting effect, each of said first value sets associated with at least one of said second values identifying a desired lighting effect;

iv. including means coupled to said at least one output of said means for entering and said local short term memory cooperating with said means for entering to store said first value set entered by said means for entering in said local short-term memory, and further for associating said first value set with at least one of said second values identifying a desired lighting effect;

v. including means for causing said local control system to produce said first value set stored in said local short-term memory at said output of said local control system in response to the presence of an associated second value identifying a desired lighting effect at said input of said local control system;

(d) at least a first means for data transmission for coupling at least said first output of said means for selecting and said inputs of said local control systems.

2. Apparatus according to claim 1, wherein said first means for data transmission comprises a serial data link.

3. Apparatus according to claim 1, wherein on of said local control systems is provided for each of said projectors provided with a means to vary.

4. Apparatus according to claim 3, wherein said first means for data transmission comprises a serial data link.

5. Apparatus according to claim 3, wherein said local control system is integral with at least said means to vary.

6. Apparatus according to any one of claims 1, 2, 3, 4, or 5, wherein said means for selecting comprises a lighting memory controller, said lighting memory controller suitable for coupling to a plurality of dimming means, each of said dimming means capable of adjusting the light output of at least one light projector, said lighting memory controller capable of generatin said second values.

7. Apparatus according to any one of claims 1, 2, 3, 4, or 5, and further including means cooperating with said means for selecting for synchronizing the operation of an external device.

8. Apparatus according to any one of claims 1, 2, 3, 4, or 5 wherein said means for entering comprises input means for a data carrier.

9. Apparatus according to claim 8, and further including means to couple said output of said means for entering with each of a plurality of said local control systems, and means for specifying with which of said outputs of said local control systems said first value entered by said means for entering is to be associated.

10. Apparatus according to claim 9, wherein said means to couple comprises a means for data transmission common to a plurality of said local control systems.

11. Apparatus according to claim 10, wherein said means to couple comprises said first means for data transmission.

12. Apparatus according to any one of claims 1, 2, 3, 4, or 5, and further including at least one means to transfer at least first value sets between said local short-term memory of each of a plurality of said local control systems and at least one means to output at least said first value sets, wherein said means to transfer comprises a means for data transmission common to a plurality of said local control systems.

13. Apparatus according to claim 12, wherein said data transmission means comprises said first means for data transmission.

14. Apparatus according to claim 12, wherein said means to output comprises display means.

15. Apparatus according to claim 12, wherein said means to output comprises output means for a data carrier.

16. Apparatus according to any one of claims 1, 2, 3, 4, or 5, and further including a means to maintain a duplicate record of at least a plurality of first value sets corresponding to said first value sets stored in said local short-term memory of each of a plurality of said local control systems, at least one means to output at least said first value sets, said apparatus further including a means to transfer capable of transfering said corresponding first value sets stored in said means to maintain to said means to output, whereby first value sets corresponding to said first value sets stored in said local short-term memory of said local control systems may be provided to said means to output without requiring the transfer of first value sets between said local control systems and said means to output.

17. Apparatus according to claim 16, wherein said means to maintain comprises a data carrier.

18. Apparatus according to claim 16, and further including means for updating cooperating with said means for entering for updating in said means to maintain, at least said first value sets entered by said means for entering, whereby correspondence may be maintained between said first value sets in said means to maintain and in said short-term memory.

19. Apparatus according to claim 18, wherein said means to maintain comprises a supervisory short-term memory.

20. Apparatus according to any one of claims 1, 2, 3, 4, or 5 wherein said means for entering comprises manually operable control means.

21. Apparatus according to claim 20, and further including means to couple said output of said means for entering with each of a plurality of said local control systems, and means for specifying with which of said outputs of said local control systems said first value entered by said means for entering is to be associated.

22. Apparatus according to claim 21, wherein said means to couple comprises a means for data transmission common to a plurality of said local control systems.

23. Apparatus according to claim 22, wherein said means to couple comprises said first means for data transmission.

24. Apparatus according to claim 21, wherein said first value set entered by said manual controls may be provided to said output of said local control system, whereby the azimuth and elevation of said beam may be directly adjusted.

25. A control system for a lighting system, said lighting system including: a plurality of light projectors, said projectors each generating a beam suitable for entertainment lighting and each of a plurality of said plurality of projectors provided with: means to vary a plurality of parameters of said beam, including the apparent color of said beam; and means to conform, said means to conform operable from a remote location, having an input, having an output coupled to said means to vary, and cooperating with said means to vary to produce a desired adjustment of said apparent color of said beam in response to the presense of a corresponding first value set at said input, said control system comprising:

(a) at least one means for selecting a desired lighting effect to be reproduced, said means for selecting disposed at a location remote from said projectors, having at least a first output, and capable of producing a plurality of second values at said first output, each of said second values identifying a desired lighting effect;

(b) at least one means for entering at least one of said first value sets corresponding to a desired apparent color adjustment for at least one of said projectors, said means for entering disposed at a location remote from said projector and having at least one output;

(c) a plurality of local control systems capable of operation at spaced apart locations, each of said local control systems:

i. having at least one input, said input coupled to at least said first output of said means for selecting;

ii. having at least one output for said first value sets each corresponding to a desired apparent color adjustment for at least one of said projectors, said output of said local control system coupled to said input of said means to conform of said at least one light projector;

iii. including a local short-term memory capable of storing at least five of said first value sets, each of said first value sets corresponding to the desired apparent color adjustment of said beam of at least one of said projectors in at least one desired lighting effect, each of said first value sets associated with at least one of said second values identifying a desired lighting effect;

iv. including means coupled to said at least one output of said means for entering and said local short term memory cooperating with said means for entering to store said first value set entered by said means for entering in said local short-term memory, and further for associating said first value set with at least one of said second values identifying a desired lighting effect;

v. including means for causing said local control system to produce said first value set stored in said local short-term memory at said output of said local control system in response to the presense of an associated second value identifying a desired lighting effect at said input of said local control system;

(d) at least a first means for data transmission for coupling at least said first output of said means for selecting and said inputs of said local control systems.

26. Apparatus according to claim 25, wherain said first means for data transmission comprises a serial data link.

27. Apparatus according to claim 25, wherein one of said local control systems is provided for each of said projectors provided with a means to vary.

28. Apparatus according to claim 25, wherein said first means for data transmission comprises a serial data link.

29. Apparatus according to claim 27, wherein said local control system is integral with at least said means to vary.

30. Apparatus according to any one of claims 25, 26, 27, 28, or 29, wherein said means for selecting comprises a lighting memory controller, said lighting memory controller suitable for coupling to a plurality of dimming means, each of said dimming means capable of adjusting the light output of at least one light projector, said lighting memory controller capable of generating said second values.

31. Apparatus according to any one of claims 25, 26, 27, 28, or 29, and further including means cooperating with said means for selecting for synchronizing the operation of an external device.

32. Apparatus according to any one of claims 25, 26, 27, 28 or 29, wherein said means for entering comprises input means for a data carrier.

33. Apparatus according to claim 32, and further including means to couple said output of said means for entering with each of a plurality of said local control systems, and means for specifying with which of said outputs of said local control systems said first entered by said means for entering is to be associated.

34. Apparatus according to claim 33, wherein said means to couple comprises a means for data transmission common to a plurality of said local control systems.

35. Apparatus according to claim 34, wherein said means to couple comprises said first means for data transmission.

36. Apparatus according to any one of claims 25, 26, 27, 28, or 29, and further including at least one means to transfer at least first value sets between said local short-term memory of each of a plurality of said local control systems and at least one means to output at least said first value sets, wherein said means to transfer comprises a means for data transmission common to a plurality of said local control systems.

37. Apparatus according to claim 36, wherein said data transmission means comprises said first means for data transmission.

38. Apparatus according to claim 36, wherein said means to output comprises display means.

39. Apparatus according to claim 36, wherein said means to output comprises output means for a data carrier.

40. Apparatus according to any one of claims 25, 26, 27, 28, or 29, and further including a means to maintain a duplicate record of at least a plurality of first value sets corresponding to said first value sets stored in said local short-term memory of each of a plurality of said local control systems, at least one means to output at least said first value sets, said apparatus further including a means to transfer capable of transfering said corresponding first value sets stored in said means to maintain to said means to output, whereby first value sets corresponding to said first value sets stored in said means to store of said local control systems may be provided to said means to output without requiring the transfer of first value sets between said local control systems and said means to output.

41. Apparatus according to claim 40, wherein said means to maintain comprises a data carrier.

42. Apparatus according to claim 40, and further including means for updataing cooperating with said means for entering for updating in said means to maintain, said first value sets entered by said means for entering, whereby correspondence may be maintained between said first value sets in said means to maintain and in said local short-term memory.

43. Apparatus according to claim 42, wherein said means to maintain comprises a supervisory short-term memory.

44. Apparatus according to any one of claims 25, 16, 27, 28, or 29, wherein said means for entering comprises manually operable control means.

45. Apparatus according to claim 44, and further including means to couple said output of said means for entering with each of a plurality of said local control systems, and means for specifying with which of said outputs of said local control systems said first value entered by said means for entering is to be associated.

46. Apparatus according to claim 45, wherein said means to couple comprises a means for data transmission common to a plurality of said local control systems.

47. Apparatus according to claim 46, wherein said means to couple comprises said first means for data transmission.

48. Apparatus according to claim 45, wherein said first value set entered by said manual controls may be provided to said output of said local control system, whereby the apparent color of said beam may be directly adjusted.

* * * * *

UNITED STATES PATENT AND TRADEMARK OFFICE

CERTIFICATE OF CORRECTION

PATENT NO. : 4,697,227

DATED : September 29, 1987

INVENTOR(S) : MICHAEL CALLAHAN

It is certified that error appears in the above—identified patent and that said Letters Patent is hereby corrected as shown below:

Col. 3, line 20, change "Pana-Spott" to --Pana-Spot --.

Col. 3, line 26, change "Panaspott" to --Panaspot--.

Col. 7, line 29, delete "referenced application" and insert --parent application Serial No. 443,127--.

Col. 11, line 66, change "rerote" to --remote--.

Col. 12, line 18, change "o" to --of--.

Col. 12, line 49, change "on" to --one--.

Col. 12, line 63, change "generatin" to --generating--.

Col. 15, line 40, after "first" insert --value--.

Col. 16, line 27, change "updataing" to --updating--.

Signed and Sealed this

Second Day of August, 1988

*Attest:*

DONALD J. QUIGG

*Attesting Officer*

*Commissioner of Patents and Trademarks*